United States Patent [19]

Stephan

[11] 3,975,024

[45] Aug. 17, 1976

[54] GOLF TRAINER DEVICE

[75] Inventor: Lawrence J. Stephan, Fairfield, Conn.

[73] Assignee: Progressive Swing Method, Inc., Fairfield, Conn.

[22] Filed: Mar. 6, 1975

[21] Appl. No.: 556,152

Related U.S. Application Data

[63] Continuation-in-part of Ser. No. 479,200, June 14, 1974, abandoned.

[52] U.S. Cl. ..... 273/193 R; 273/195 A; 273/202; 273/77 A

[51] Int. Cl.[2] ..... A63B 69/36

[58] Field of Search ..... 273/195 B, 202, 197, 273/193, 194, 183, 196, 195 R, 195 A, 77 A, 35, 198

[56] References Cited

UNITED STATES PATENTS

| | | | |
|---|---|---|---|
| 2,879,996 | 3/1959 | Lederer | 273/195 B X |
| 2,937,875 | 5/1960 | Mason et al. | 273/195 B |
| 2,976,041 | 3/1961 | White | 273/202 X |
| 3,765,683 | 10/1973 | Landry | 273/202 X |

*Primary Examiner*—George J. Marlo
*Attorney, Agent, or Firm*—Wooster, Davis & Cifelli

[57] ABSTRACT

A golf trainer device is comprised of a platform for supporting a golf ball thereon and means for adjustably supporting said platform at selectable heights above ground level. A novice golfer utilizes the device at different heights with short golf clubs beginning with a club approximately fifteen inches long and progressing to longer clubs as the novice improves. The platform is supported by an adjustably telescoping stem and stanchion or by sets of parallel spaced apart pivotally interconnected legs. The platform is covered with synthetic turf and a replaceable resilient golf tee is provided.

3 Claims, 14 Drawing Figures

Fig. 9.
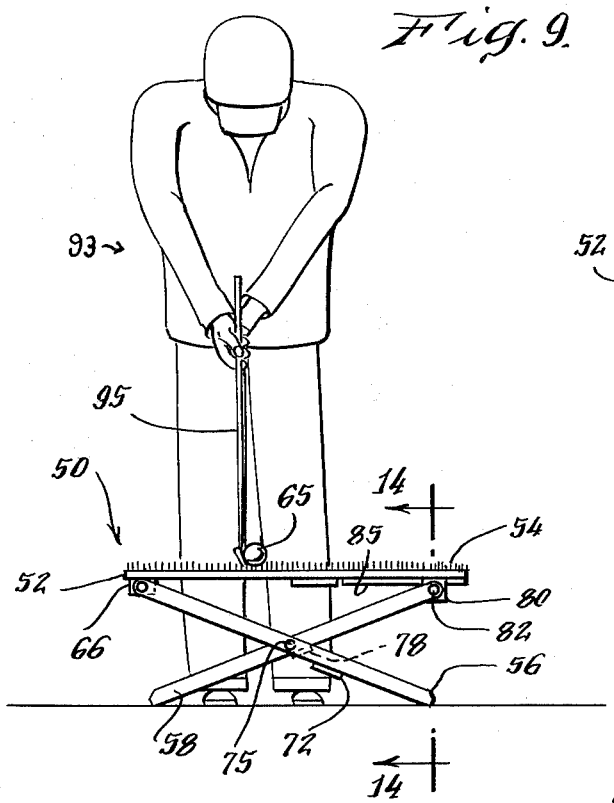
Fig. 10.
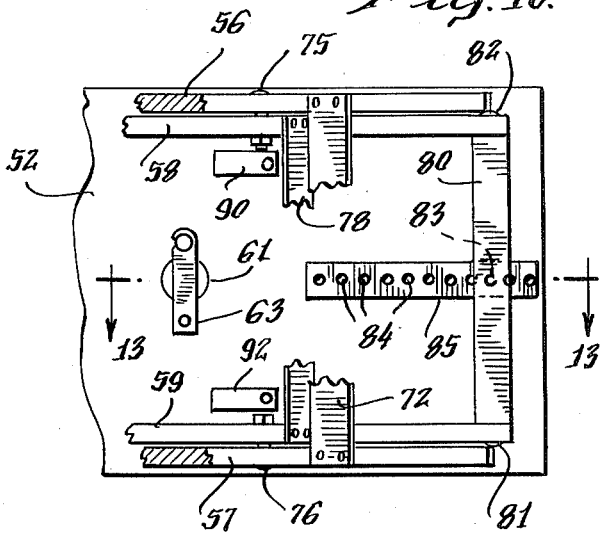
Fig. 11.
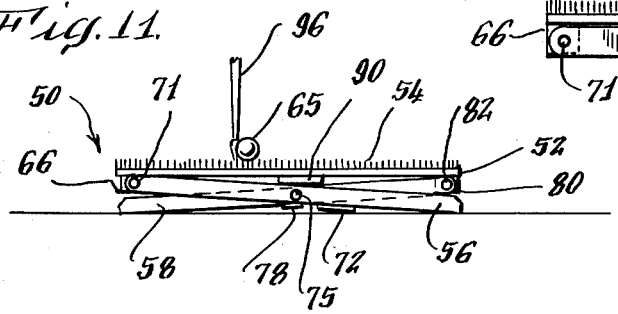
Fig. 12.
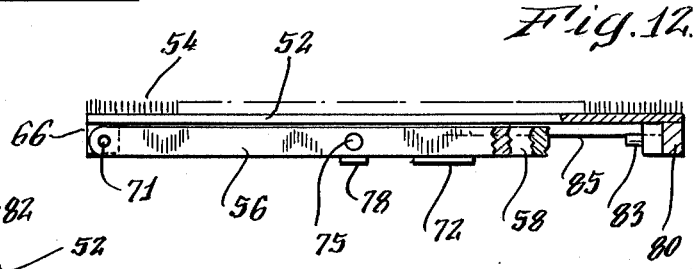
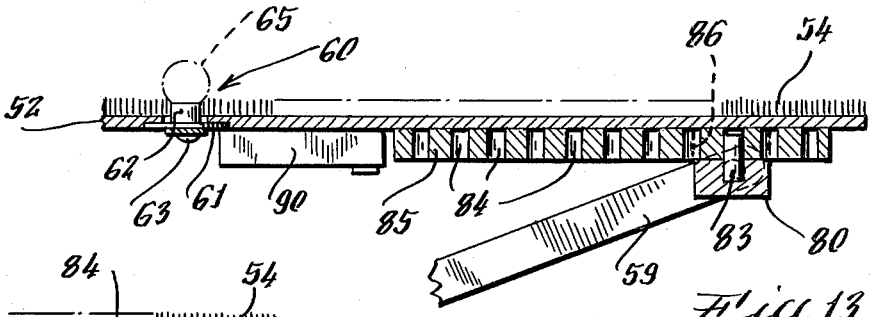
Fig. 13.
Fig. 14.
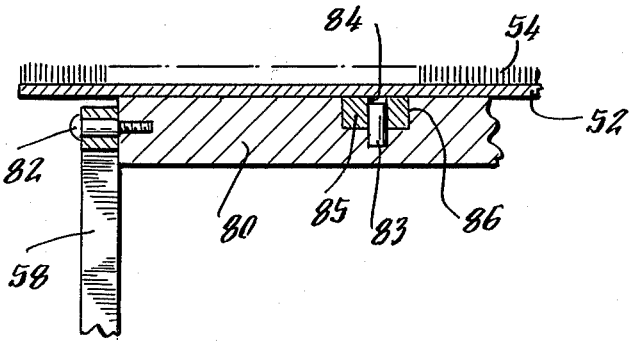

GOLF TRAINER DEVICE

This application is a continuation-in-part of my application Ser. No. 479,200, filed June 14, 1974, now abandoned.

BACKGROUND OF THE INVENTION

The present invention pertains to a device for teaching novices in the game of golf. This invention provides a golf ball supporting platform, adjustable in height for use with golf clubs of less than standard lengths, the height of the golf ball supporting platform being adjusted to correspond to the length of the club.

Some novice golfers cannot control standard length golf clubs well enough to strike a golf ball. It is extremely difficult for the novice to learn the proper form of a golf swing when such a complete absence of control over the golf club exists.

It has been found that novice golfers can, however, control very short golf clubs, and that the basic form of a good golf swing can be taught to a novice golfer utilizing a short golf club. The short golf club is simple to control, and the novice golfer has great success in striking the ball and developing the proper form to do so. It has also been found that the novice golfer can progress to the use of standard length clubs by stages and accordingly can master the technique for proper golf swing with a minimum of difficulty.

SUMMARY OF THE INVENTION

This invention provides a platform for supporting a golf ball which may also include a golf tee located thereon. The golf ball support platform is adjustable in height to enable a novice golfer to learn the proper swing techniques commencing with a relatively short golf club. For instance, a golf club 15 inches in length can be used by the novice golfer to strike a golf ball from the golf ball support platform when it is adjusted to a high position. The golf ball support platform is adjustably lowered as the student golfer progresses to the use of longer length golf clubs, after periods of practice, determined by the aptitude of the student, until he or she progresses to the use of standard golf club lengths.

Accordingly, an object of this invention is to provide a golf ball support platform adjustable in height for use with golf clubs of correspondingly shortened length.

An additional object of the invention is to provide a golf ball support platform which may be easily and quickly manipulated to vary its height.

Yet another object of the invention is to provide a height-adjustable golf ball support platform which is portable.

Other and more particular objects of the invention will, in part, be obvious and will, in part, appear from a perusal of the following description of the preferred embodiments and the claims, taken together with the drawings.

DRAWINGS

FIG. 9 is a side elevation view of the golf trainer device of FIG. 5 adjusted to an intermediate height position;

FIG. 10 is a bottom plan sectional view of the golf trainer device of FIG. 5 adjusted to the intermediate height position shown in FIG. 9;

FIG. 11 is a side elevation view of the golf trainer device of FIG. 5 adjusted to a low position;

FIG. 12 is a side elevation view of the golf trainer device of FIG. 5 shown folded flat;

FIG. 13 is a sectional view of the golf trainer device of FIG. 5 taken along the lines of 13—13 of FIG. 10; and FIG. 14 is a sectional view of the golf trainer device of FIG. 5 taken along the line 14—14 of FIG. 9.

The same reference numbers refer to the same elements throughout the various Figures.

DESCRIPTION OF PREFERRED EMBODIMENTS

Figure 1:
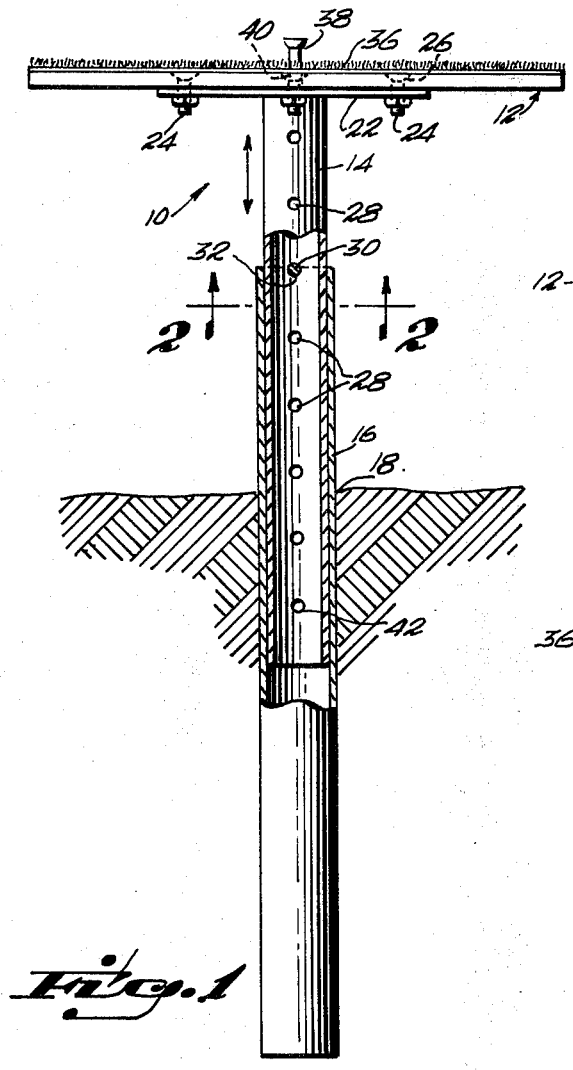
FIG. 1 is a side elevation view of a golf trainer device according to the invention herein.
Figure 2:
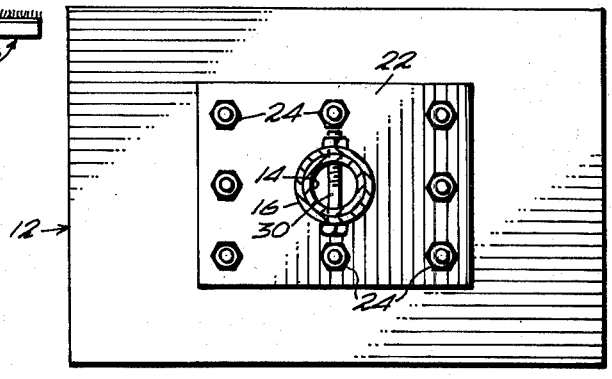
FIG. 2 is a sectional view of the golf trainer device of FIG. 1 taken along the line 2—2 of FIG. 1.

Referring now to FIG. 1, there is shown a first embodiment 10 of a golf trainer device according to the invention herein. The golf trainer device 10 is comprised of a table top or golf ball support platform 12, a vertical stem 14 extending downwardly therefrom and adjustably received in telescopic engagement within a stanchion 16 firmly implanted in the ground, as indicated at 18.

The upper end of the stem 14 is fixed to the platform 12, and this may be achieved by welding the upper end of stem 14 to a horizontally disposed plate 22 and bolting the horizontally disposed plate 22 to the central underside of the platform 12 by means of bolts 14. Preferably the bolts 24 are countersunk in the table top support surface 12 as illustrated at 26 of FIG. 1.

Figure 4:
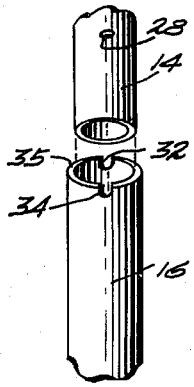
FIG. 4 is a fragmentary, exploded, perspective view of the telescopic connection between the stem and stanchion of the golf trainer device of FIG. 1.

A plurality of vertically aligned, spaced apart index holes 28, the lowermost of which are designated at 42, are diametrically disposed through the stem 14 along the length thereof. A bolt 30 is selectively received therethrough for seated engagement across a pair of diametrically disposed notches 32 and 34 (best seen in FIG. 4) in the top edge 35 of the stanchion 16. By positioning the bolt 30 in various ones of the index holes 28, the elevation or height of the platform 12 is adjustable relative to the ground level, and the seating of the bolt 30 in notches 32 and 34 holds the platform 12 against rotational movement during use.

Figure 3:
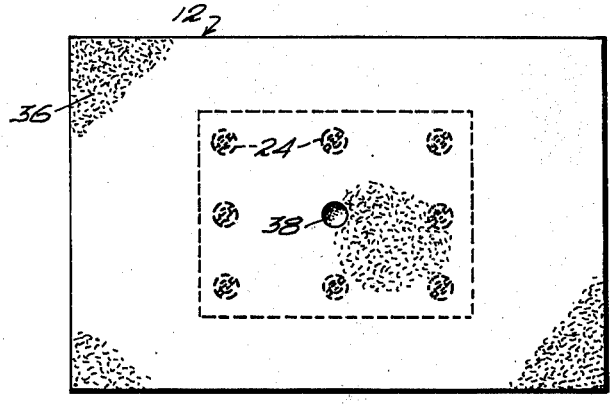
FIG. 3 is a top plan view of the golf trainer device of FIG. 1.

As illustrated in FIGS. 1 and 3, the platform 12 may be covered with a synthetic turf 36 such as the commercially available Astroturf. A golf tee 38, preferably made of rubber, is removably and preferably centrally mounted relative to the upper surface of the platform 12. For example, the golf tee 38 may plug into a hole 40 in the platform 12.

When the golf trainer device 10 is used by a beginning golf student, the bolt 30 is extended through the lower most index hole 42 and seated in the diametrically disposed notches 32 and 34 of stanchion 16, whereby the platform 12 is elevated to its maximum height. A golf ball is placed on the golf tee 38 or directly on the synthetic turf 36, and the beginning golf student may use a short golf club approximately 15 inches long to strike the golf ball. Because of the shortness of the golf club and the closeness of the ball, striking the ball is much easier than striking a golf ball placed at ground level with a standard length club. After a period of practice with the golf trainer device 10 at its most elevated height, the golf student progresses to the use of a golf club of somewhat longer length and the platform 12 is proportionally lowered by moving the bolt 30 to one of the intermediate ones of the index holes 28. After periods of practice with golf clubs of progressively longer lengths utilized to strike golf balls from the table top support surface 12 at correspondingly progressively lower heights, the student golfer rapidly masters the techniques involved in a proper back swing, forward swing to strike the golf ball, and follow through. In this manner, the student golfer progresses to the use of a standard length golf club while developing proper swing techniques.

Figure 5:
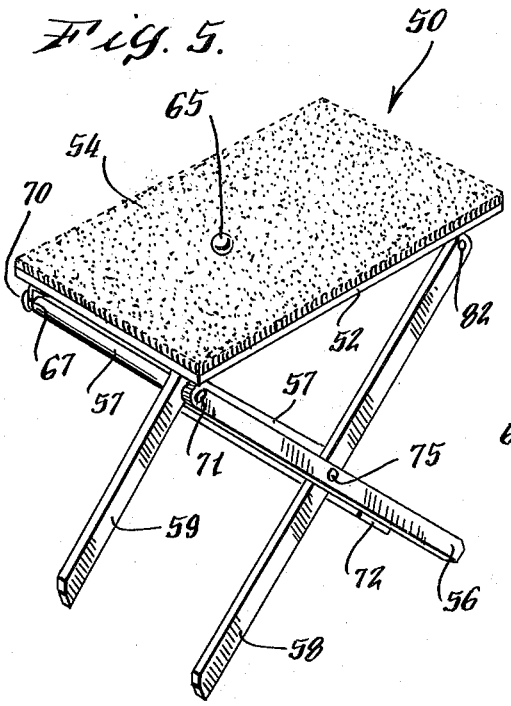
FIG. 5 is a perspective view of another golf trainer device according to the invention herein.

Referring now to FIG. 5, there is shown a second embodiment 50 of a golf trainer device according to the invention herein. The golf trainer device 50 generally comprises the golf ball support platform 52 which may be covered with synthetic turf 54, a first set of legs 56 and 57, and a second set of legs 58 and 59 which support the golf ball support platform 52 at various selectively adjustable heights. A golf tee 60 may support a golf ball 65 above the synthetic turf 54 of platform 52, or the golf ball may be placed directly on the synthetic turf.

Figure 6:
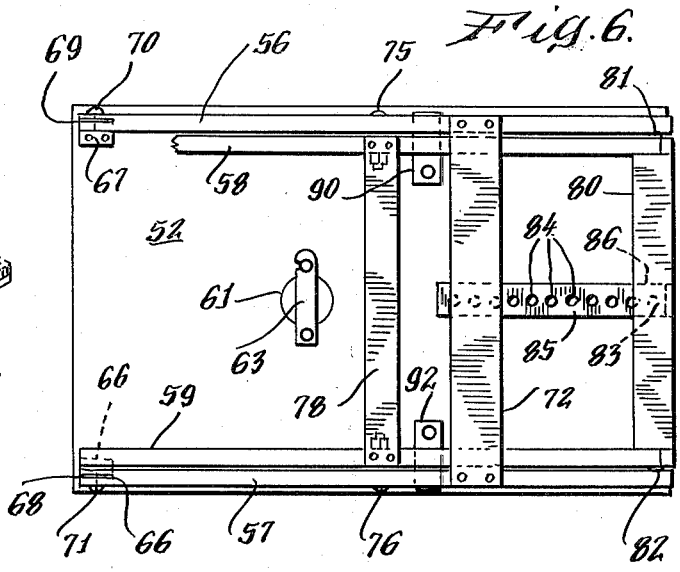
FIG. 6 is a bottom plan view of the golf trainer device of FIG. 5.

The first set of legs 56 and 57 are pivotally connected to the underside of platform 52 along a common axis generally parallel with one edge of the platform 52. This may be achieved by L-shaped brackets 66 and 67 secured to the underside of the platform 52 with their downwardly depending legs respectively received in slots 68 and 69 in legs 56 and 57, and secured therein by bolts 70 and 71, as best seen in FIG. 6. The legs 56 and 57 are inclined, extending downwardly along the side edges of the platform 52. The legs 56 and 57 are maintained in spaced parallel relationship by a cross member 72 and the mounting brackets 66 and 67.

The second set of legs 58 and 59 are respectively pivotally connected to the first set of legs 56 and 57 at approximately the mid-points thereof by bolts 75 and 76. The second set of legs 58 and 59 are maintained in parallel spaced relationship by a first cross member 78 and by a second cross member 80. The second cross member 80 is pivotally mounted between the upper ends of legs 58 and 59 by screws 81 and 82. The cross member 80 has a peg 83 protruding outwardly therefrom, and the peg is selectively positioned in one of a plurality of openings 84 in a longitudinal track member 85 secured to the underside of the platform 52. Referring particularly to FIG. 14, the cross member 80 is preferably provided with a slot 86 in which the longitudinal track member 85 is received to secure the cross member 80 against lateral movement. FIG. 14 also shows the peg 83 inserted in one of the openings 84 in the longitudinal track member 85.

The particular one of the openings 84 in the longitudinal track member 85 into which peg 83 of the cross member 80 is positioned determines the height at which the legs 56 – 59 support the platform 52.

The golf tee 60, best seen in FIG. 13, is preferably fabricated of a resilient material such as rubber, and comprises a flat disc-like base 61 and a tubular portion 62 extending upwardly therefrom. The base 61 is held in a recessed area on the underside of the platform 52 by means of a pivotable clip 63, and the tubular portion 62 of the golf tee 60 extends upwardly through the platform 52 and protrudes slightly above the synthetic turf 54 thereon. Thus, the golf tee 60 may be easily removed and replaced should it become damaged or worn.

A pair of spacer blocks 90 and 92 are pivotally mounted to the underside of the platform 52. The spacer blocks are positioned such that they can be pivoted generally parallel and adjacent to the legs 56 – 59 of the golf trainer device 50, and also can be pivoted into the position illustrated in FIGS. 6 and 11 wherein the spacer blocks 90 and 92 are disposed respectively across legs 56 – 57 and 58 – 59 of the golf trainer device 50. As illustrated in FIG. 11, the spacer blocks can be utilized to space the legs 56 – 59 from the underside of the platform 52 and provide a low height adjustment of the golf trainer device 50. The large forces which would be exerted on the longitudinal track member 85 by the peg 83 when the golf trainer device is in its low height adjustment are avoided. When the spacer blocks 90 and 92 are pivoted to the position shown in FIG. 8, the golf trainer device 50 can be folded flat for storage or transport, as shown in FIG. 12.

The advantages of this second embodiment 50 of the golf trainer device are primarily that it is portable, and can be used in any location, both indoors and out, although the use of plastic or soft simulated golf balls is recommended for indoor use. Further, it folds flat for convenient carrying and compact storage.

Figure 7:
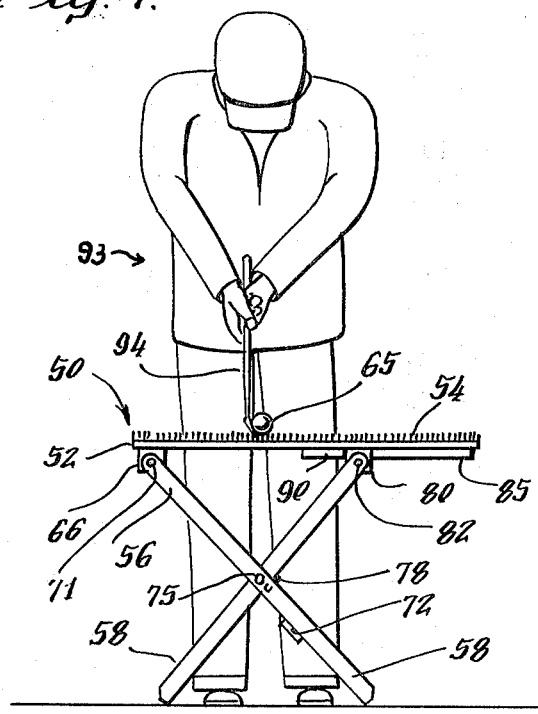
FIG. 7 is a side elevation view of the golf trainer device of FIG. 5 adjusted to a high position.
Figure 8:
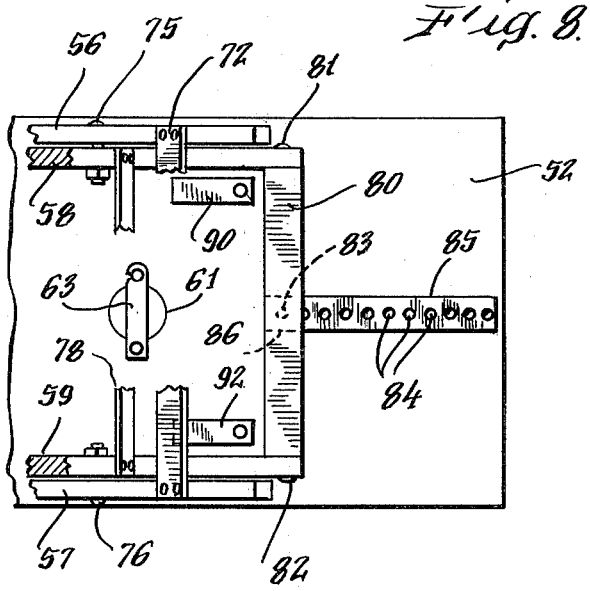
FIG. 8 is a bottom plan view partially cut away, of the golf trainer device of FIG. 5 adjusted to the high position shown in FIG. 7.

Referring now to FIG. 7, the golf trainer device 50 is shown in its uppermost or maximum height position. Referring now to FIG. 8, which is a bottom plan view of the golf trainer device 50 adjusted to the height shown in FIG. 7, it can be seen that the peg 83 protruding from cross member 80 is in the innermost opening 84 in the longitudinal track member 85. A golfer, indicated at 93, is shown using a golf club 94 of 15 inches in length to strike the golf ball 65. The short golf club 94 is simple to control, and even novice golfers are able to make contact with the ball. Thus, the fundamentals of a golf swing can be learned by the golfer because he has more control over the short golf club than he would over a club of standard length.

In FIG. 9, the golf training device 50 is shown adjusted to an intermediate height position. In the corresponding bottom plan view of the golf trainer device 50 shown in FIG. 10, it can be seen that the peg 83 of cross member 80 is positioned in one of the openings 84 of longitudinal track member 85 located nearer the edge of the platform 52. The golfer, again indicated at 93, is shown using a golf club 95 of intermediate length, on the order of 21 inches in length, to strike the golf ball 65. The golfer is prepared and able to control the longer club 95 through the skills acquired using the short club 94.

Referring now to FIG. 11, the golf trainer device 50 is shown in its lower most position, wherein the spacer blocks 90 and 92 are interposed between the legs 56 – 59 and the underside of the table top support surface 52. The golfer, not shown, may use a golf club 96 of slightly greater length than the golf club 95, on the order of 26 inches in length. Again, the skills acquired in using shorter golf clubs permit the golfer to exercise sufficient control over the longer club to accurately and consistently strike the golf ball 65.

The student golfer may then progress to the use of still longer golf clubs, for example and preferably an iron 31 inches in length and a wood 35 inches in length, to strike the golf ball from the surface of the golf trainer device 50. Thereafter, the student golfer can progress to the use of standard length golf clubs.

Thus, golf trainer devices which achieve the objects of the invention have been disclosed. It will be appreciated that various changes in the golf trainer devices disclosed above can be made without departing from the spirit and scope of the invention, which is defined in the following claims.

What I claim is:

1. Apparatus for golf training comprising: three golf clubs each having a different length, one of said lengths being 15 inches and the other two lengths being in a range between 15 inches and 35 inches with said three lengths being significantly different from each other; a platform for supporting a golf ball thereon; and means for supporting said platform above a ground surface, said means being adjustable to support said platform at three significantly different heights above said ground surface, each of said heights permitting a golfer to hit a golf ball from said platform with each of said golf clubs.

2. Apparatus for golf training as defined in claim 1 wherein said three significantly different lengths are 15, 21 and 26 inches.

3. Apparatus for golf training as defined in claim 1 and including a fourth golf club, one of said four golf clubs having a length of 15 inches, one of said golf clubs having a length of 24 inches, one of said golf clubs having a length of 31 inches, and one of said golf clubs having a length of 35 inches and wherein said means for supporting said platform above a ground surface is adjustable to support said platform at a fourth height above said ground surface.

* * * * *